United States Patent [19]

Viljanmaa

[11] Patent Number: 4,802,348

[45] Date of Patent: Feb. 7, 1989

[54] APPARATUS FOR TENTERING HIDES

[76] Inventor: Leena Viljanmaa, Mainausstrasse 179, Konstanz, Fed. Rep. of Germany

[21] Appl. No.: 97,365

[22] Filed: Sep. 10, 1987

Related U.S. Application Data

[63] Continuation of Ser. No. 770,959, filed as PCT FI85/00009 on Jan. 24, 1985, published as WO85/03309 on Aug. 1, 1985, abandoned.

[30] Foreign Application Priority Data

Jan. 25, 1984 [FI] Finland ..... 840289

[51] Int. Cl.[4] ..... C14B 1/02

[52] U.S. Cl. ..... 69/33; 26/99; 69/47

[58] Field of Search ..... 26/87, 99; 69/1.5, 33, 69/47

[56] References Cited

U.S. PATENT DOCUMENTS 3,235,644 2/1966 Rasmussen ..... 26/87 X

FOREIGN PATENT DOCUMENTS 1811999 6/1970 Fed. Rep. of Germany ..... 69/33
1760381 8/1972 Fed. Rep. of Germany ..... 69/33
2267268 11/1975 France ..... 69/33
545277 5/1942 United Kingdom ..... 26/99

*Primary Examiner*—Wm. Carter Reynolds
*Attorney, Agent, or Firm*—Schiller, Pandiscio & Kusmer

[57] ABSTRACT

An apparatus for tentering a hide including endless tentering mats (1, 2) driven along continuous upper and lower paths. The mats (1, 2) are pressed together over a portion of the continuous path by compressed air. A stretching assembly that grips the mat edges is used to continuously stretch the portions of the mats that are pressed together as they advance. An endless wire (5) is used to feed hides into the nip between the mats (1, 2).

12 Claims, 4 Drawing Sheets

APPARATUS FOR TENTERING HIDES

Figure 1:
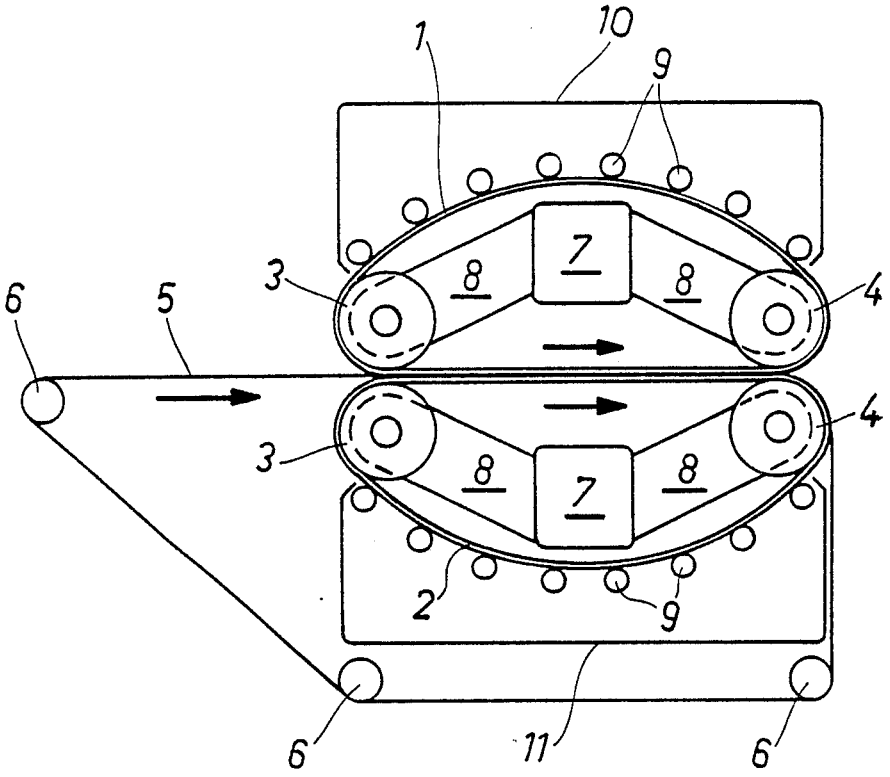

This is a continuation of application Ser. No. 770,959, filed as PCT F185/00009 on Jan. 24, 1985, published as W085/03309 on Aug. 1, 1985, now abandoned.

The invention relates to a method of tentering a hide, wherein endless, elastic tentering mats are circulated along an upper and lower endless run and a hide is squeezed between the tentering mats and tentering is effected by stretching the mats in a direction crosswise relative to the running direction. The invention relates also to an apparatus for carrying out the method and the apparatus comprises two annular or hoselike hide tentering mats, adapted to circulate along endless runs in a manner that the lower run of the upper mat is squeezed or pressed against the upper run of the lower mat, said mats being made of an elastically extensible material, and mat stretching means for stretching the face-to-face pressed runs of said mats in a direction crosswise relative to the running direction. Tentering of a hide serves to open its fiber structure for softening a hide. At the same time, the surface are increases.

It is prior art to carry out the above type of method and apparatus in single action so that the edges of circular or elliptical stretching mats are gripped by a plurality of radial stretching means for stretching the mats radially from center towards the sides. The face-to-face pressed edges of the mats are sealed and the mats are squeezed face-to-face by sucking a vacuum in the space between the mats. This prior art method and apparatus involve several drawbacks. First of all, a single-action method is slow as all various steps of the method must be repeated separately for each hide to be tentered. Secondly, the construction is sophisticated and expensive as it requires a plurality of radial power units for stretching the mats. Thirdly, the compressive force is irregular since the vacuum is not distributed evenly all the way to the central area of a hide. This results in irregular stretching of a hide. In the fourth place, the apparatus has proved unreliable as to its durability, since the stretching mats have often been ripped adjacent to the rim-gripping fastening means or at the vacuum duct lead-in. When a mat is stretched in all directions, the length of its rim increases but the rim-gripping fastening means of said stretching units prevent the increase of peripheral length over approximately half of the peripheral distance, the increase of the peripheral length occurring as a disproportionately large peripheral elongation between the gripping means, resulting in untimely tearing.

French Patent publication No. 2 267 268 discloses a hide stretching means, wherein the stretching elements in the form of aperture discs are adapted to be shifted along an endless run or track. The side runners of said track comprise a section where the side runners are closer to each other, whereby the forcepts gripping the hide edges can be secured in the nearest apertures of said aperture discs. Thereafter, the side runners are drawn away from each other to the plane of the side runners of the rest of said track and the tentering track is shifted forward. The apparatus is not a continuous-action unit but the fastening and removal of hides must be effected as tedious manual work with the track stopped. Neither is stretching of the mats based on continuous mat stretching as the mats advance forward but, instead, the stretching occurs first locally and most of the endless track or run serves like a storage for stretched hides. This prior art device is slow and requires a lot of work. The capital costs and operating costs will be high in terms of productive capacity. FI Patent application No. 823457 and DE publication print No. 1 760 381 disclose tentering and stretching of a hide between endless, elastic mats. Stretching of the mats is effected by means of special ram members for working mechanically from each side of the face-to-face pressed sections of the mats. Thus, the compressive engagement between mats and a hide is local, resulting in relative slipping between mats and a hide in areas which lack sufficient compression. For example, the crosswise stretching results in lengthwise retraction of a hide. When, at the point of stretching, said stretching mats have extended more than a hide to be stretched, a consequence is that, after the point of stretching, with the mats retracted to their original state, said mats crumple a hide therebetween resulting in the formation of wrinkles thereon.

An object of the invention is to provide a continuous-action method and apparatus for tentering the hides at a high productive capacity while ensuring the prime quality work by pressing or squeezing a hide to be tentered entirely between the mat runs to be stretched with sufficient and uniform compressive force.

This object is achieved on the basis of the inventive features set out in the annexed claims.

Figure 2:
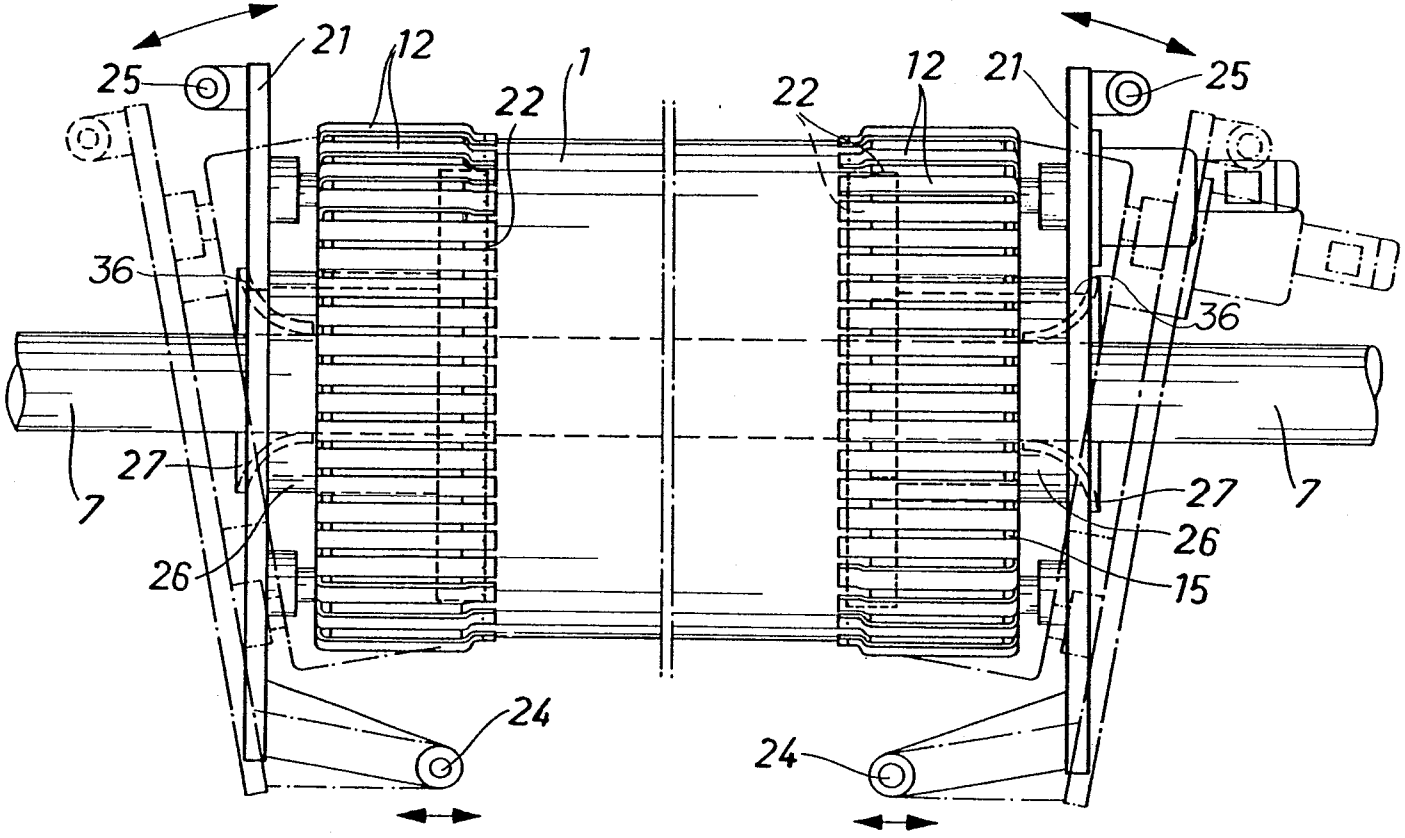

One embodiment of the invention will now be described in detail with reference made to the accompanying drawings, in which FIG. 1 is a schematic vertical section of an apparatus of the invention and FIG. 2 is a cross-sectional view taken along line 2—2 shown in FIG. 3 and partially cut away.

Figure 3:
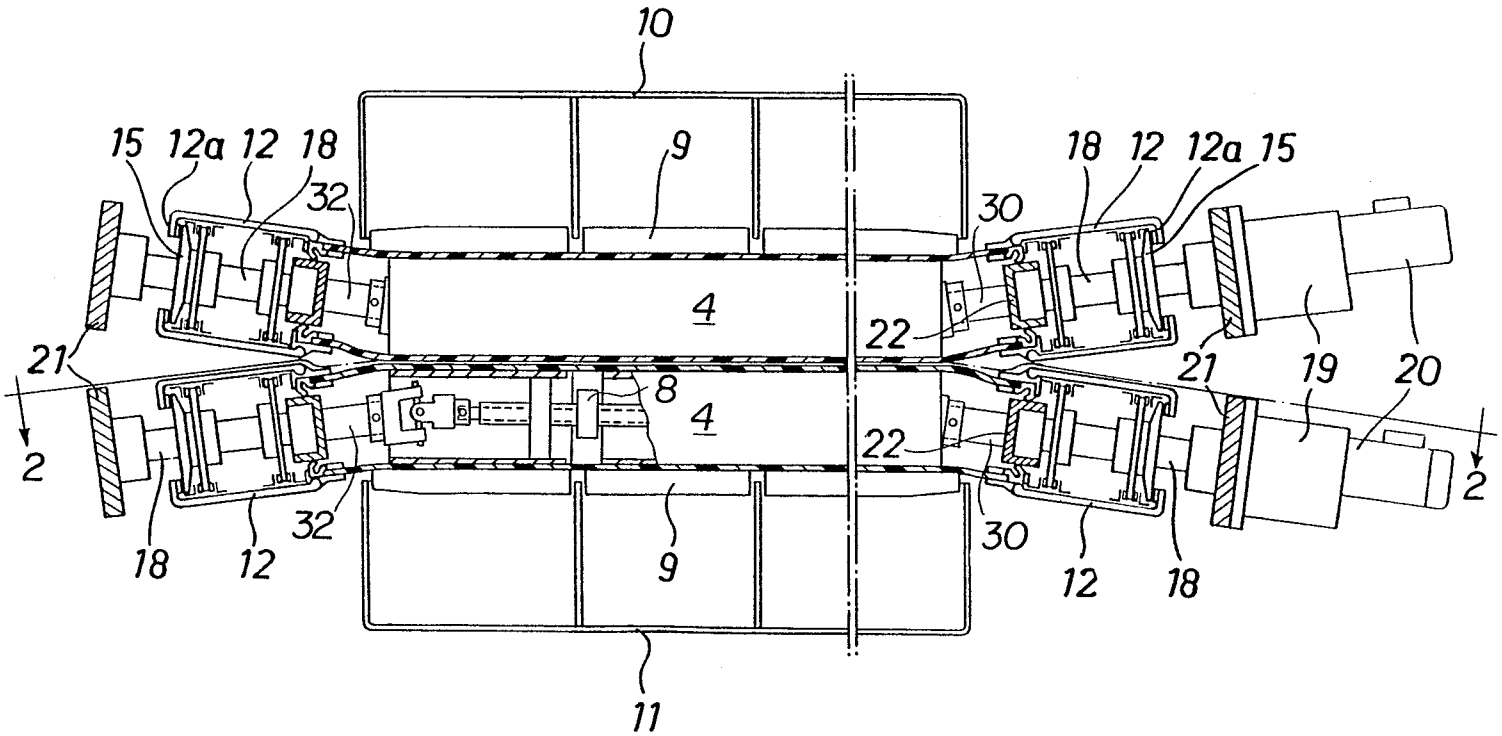
Figure 4:
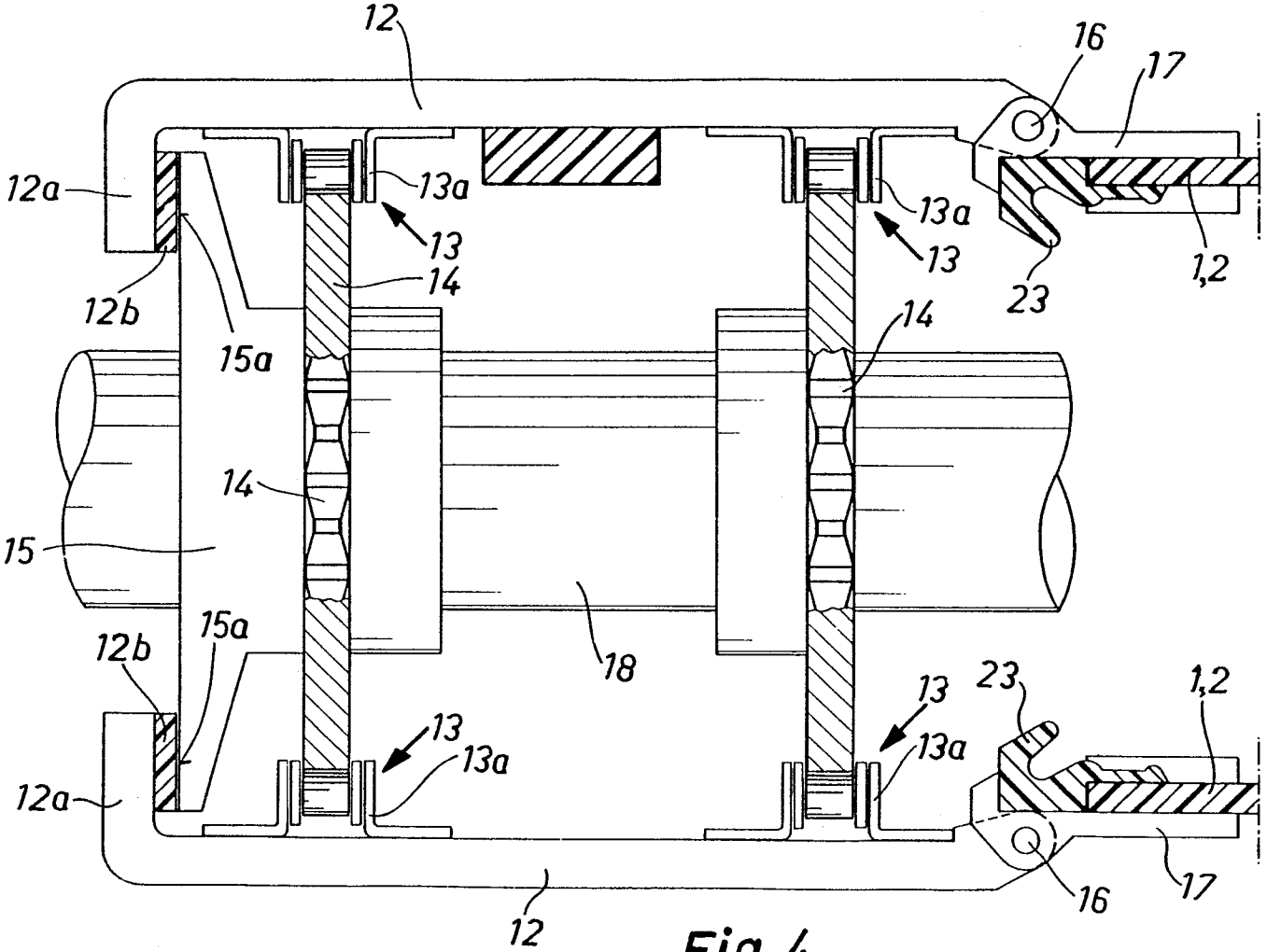

FIG. 3 shows a cross-section taken through the rear end of the apparatus and FIG. 4 illustrates a detail shown in FIG. 3 to a larger scale.

It is to be appreciated that the apparatus comprises a frame (not shown) to which various elements of the apparatus may be mounted.

As shown in FIG. 1, two endless tentering mats 1 and 2 are adapted to circulate along an upper and lower endless run. Mats 1 and 2 are passed around swing rollers 3 and 4, wherein mats 1 and 2 take the shape of flattened cylinders open at opposite sides (ends), the side openings being hereinafter referred to as mat eyelets. Swing rollers 3 and 4 are located at the outset and terminal ends of the face-to-face pressed run sections of mats 1 and 2. The terminal end rollers 4 are adapted to be driven in a manner described in more detail later, so that the face-to-face pressed run sections of mats 1 and 2 travel in the direction indicated by the arrows.

The face-to-face pressing of mats 1 and 2 over the entire area with a uniform pressure is accomplished by means of compressed air supplied inside the mate eyelets. The open ends of mat eyelets are closed and sealed as described later.

Mats 1 and 2 are made of an elastic material, such as rubber, the mats being extensible crosswise relative to their running direction. At least the rim areas of mats 1 and 2 are provided with reinforcing wires, extending in the running direction and keeping constant the peripheral length of mat eyelets.

The hides to be tentered are fed in between mats 1 and 2 by means of an endless wire 5, running between the face-to-face pressed sides of mats 1 and 2. Wire 5 is also extensible crosswise relative to the running direction. The return run of wire 5 is passed around swing rollers 6, one swing roller 6 being positioned so as to build in front of the feed-in point between rollers 3 an elongated delivery table for spreading a hide to be tentered thereon.

The hide tentering is thus effected by stretching the face-to-face pressed run sections of tentering mats 1 and 2 crosswise relative to the running direction in a manner that the stretching force and stretching distance or elongation increase continuously towards the terminal end of the nip between said mats. As a hide will thus be tentered in a single delivery in one direction, each hide must be delivered through a continuous-action tentering apparatus twice, the second tentering step serving to stretch a hide in the direction perpendicular to the stretching direction of the first tentering step. Despite the double delivery, the continous action of the apparatus means that the increase of the rate of speed will be approximately triple, as compared to a single-action apparatus.

Although the tentering could, in principle, be effected in all directions at the same time (which solution is not beyond the scope of invention), the present embodiment is preferred as it increases the durability and service life of a rubber mat, simplifies the apparatus construction and, by means of two separate stretching or elongation perpendicular to each other, the fiber structure can be opened more effectively than by effecting the elongation in all directions at one time. Thus, a hide can be softened more effectively.

Extended through mat eyelets are main pipes 7 from which extend bars 8, with swing rollers 3 and 4 journalled thereon. Compressed air can be supplied into mat eyelets through main pipes 7.

The return runs of mat eyelets are on the outside supported by means of rollers 9, mounted on cover sections 10 and 11. Cover sections 10 and 11 can be removed in whole units for maintenance or replacement of the tentering mats.

The following describes in more detail the tentering means for gripping the edges of tentering mats 1 and 2, with reference to FIGS. 2–4. To both edges of mat 1, 2 are fastened adjacent track shoes 12 which, together with chains 13 fastened to the inner surfaces of said track shoes, build up chain tracks which follow the mat edges. Each extreme chain link 13a of chains 13 is secured to a track shoe 12. The articulated shafts 30 and 32 of chains 13 lie in the same plane as the middle plane of mat 1, 2. Thus, no stresses are produced at the reversing points between mat 1, 2 and chain track 12, 13. At the positions corresponding to the swing rollers 3 and 4 of mats 1 and 2 there are provided sprockets 14, whose shafts 18 are journalled to frame plates 21. The shafts 18 with its sprockets 14, positioned at the rear end rollers 4, are connected by way of a reduction gear 19 to a motor 20. Drive shafts 18 are connected by means of articulated shafts 30 to the corresponding rear end rollers 4, whose opposite ends are in turn connected by means of articulated shafts 32 to shafts 18 on the left in FIG. 3, both rear end rollers 4 and the chain tracks at both edges of mats 1 and 2 being thus driven. In FIG. 3, rollers 4 and the articulated shafts 30 and 32 engaging their ends are shown connected in a manner well known in the art. The angle of inclination of shafts 18 shown in FIG. 3 serves to stop the stretching of mats 1 and 2 immediately after the nip of rollers 4, said stretching not proceeding to the outermost point of rollers 4 where no stretching any longer occurs. The angle of inclination of shafts 18 is also significant in terms of space utilization since, despite the described chain track construction, the mats can be guided against each other.

For the lateral stretching of the mats, the ends of track shoes 12 are provided with hook-like members 12a to whose inner surfaces are fastened slide members 12*b*, made of e.g. plastics and rested against the surface 15*a* of a guide track 15. A guide track 15 can be made as a single integral element whose outline follows the shape of the mat eyelets shown in FIG. 1. As an alternative, a guide track 15 may comprise two wheels mounted on shafts 18 and a fixed member extending therebetween. What is essential is that guide tracks 15 are secured to end plates 21 that can be pivoted to the position shown by dot-dash-lines in FIG. 2 whereby, when progressing in the hide-feeding direction, said end plates 21 and simultaneously therealong said guide tracks 15 together with their guide surfaces 15*a* diverge from each other on the opposite sides of the apparatus. A result of this is that the face-to-face pressed sides of rubber mats 1 and 2, advancing in the diverging direction of guide tracks 15, will be tentered or stretched in lateral direction. The stretching force is transmitted by way of the bent ends 12*a* of track shoes 12 and slide members 12*b* to the surfaces 15*a* of guide tracks 15. The return runs of mats 1 and 2, in turn, travel in the direction in which the guide tracks 15 on the opposite sides of said apparatus converge, the elasticity of said mats brings the mats back to their original width for renewed stretching and tentering. It can now be appreciated that the inclined position of shafts 8, tracks 15 and end plates 21, as shown in FIG. 3, results in quicker set-off of retraction without unnecessary extra stretching after the nip between rollers 4.

The elongation or degree of tentering of mats 1 and 2 can be readily adjusted while mats 1 and 2 are circulating by means of a piston-cylinder unit, which grips the frame 21 at a point 25 and is capable of turning plate 21 around a shaft 24. The turning point 24 can also be shifted crosswise of the apparatus, whereby the permanent elongation remaining in the mat can be compensated for whenever necessary.

Each track shoe 12 is fastened by means of a link 16 to a metal gripping plate 17, which is riveted to a metal sheet on the opposite side of the edge of mat 1, 2. At the same time, between the fastening plates is sqeezed a lip seal 23, leaning against an end plate 22 shown in FIG. 3. Each open end of both mat eyelets is closed with an end plate 22 matching the shape of a mat eyelet (see FIG. 1). Thus, the internal space of said mat eyelets has been made air-tight for compression with compressed air. Hence, the compressive force is uniform over the entire face-to-face pressed area of mats 1 and 2.

As shown in FIG. 2, end plate 22 is connected to frame plate 21 by way of a pipe 26. The lead-in of a main pipe 7 extends through apertures 36 (FIG. 2) in frame plates 21 and is sealed with a sealing 27 to said frame plate 21.

Energy consumption of the apparatus is low since the energy used for stretching the rubber mats is largely recovered as a thrust generated by the retraction of mats occurring on the return side. This advantage cannot be found in a single-action device.

It is appreciated that the above-described apparatus construction is just one exemplatory embodiment, with a plurality of modifications conceivable to a skilled person within the scope of the invention. For example, a guide track can be made of successive rollers, which engage themselves behind the catch members provided on or fastened to the edges of tentering mats.

I claim:

1. An apparatus for tentering a hide, said apparatus comprising first and second angular or hose-like hide tentering mats (1, 2), each open at opposite sides thereof, said mats being adapted to circulate along endless runs in predetermined directions so that a portion of the first mat is pressed in face-to-face opposing relation with and moves in the same direction as a portion of the second mat, said mats being made of an elastically extensible material, and mat stretching means for stretching both said portions of said first and second mats in a second direction crosswise to said direction, wherein the improvement comprises means for sealing (22, 23) said opposite sides of each of said first and second mats so as to respectively form closed pressure chambers or spaces, and wherein said mat stretching means comprises edge-gripping track shoes (12) attached to said mats, and guide tracks (15) for defining running paths for said track shoes, said guide tracks being adapted to simultaneously advance in said second direction and diverge from each other (1) in order to produce diverging running paths for said track shoes (12) and (2) so as to stretch said portions of said mats in said second direction crosswise relative to said direction.

2. An apparatus as set forth in claim 1, wherein the improvement futher comprises an endless wire (5), which runs between said portions of the mats and extends a substantial distance rearwards of a point where hides are fed into said apparatus.

3. An apparatus as set forth in claim 1, further comprising: chains (13), fastened to said said track shoes, for driving the track shoes, said chains and said track shoes (12), comprising chain tracks for gripping the edges of said mats.

4. An apparatus as set forth in claim 3, further comprising swing rollers (3, 4), positioned at opposite ends of and adapted to rotatably support said first and second portions of said mats (1, 2); a drive motor (20); means, including articulating shafts, for coupling at least some of said swing rollers (4) to said drive motor (20); frame plates (21); shafts (18) journalled to said frame plates; and sprockets (14) mounted on said shafts (18) for engaging said chains (13) and for translating the direction of travel of said chain tracks (12, 5. An apparatus as set forth in claim 1, further comprising means (9) for supporting said first and second mats so as to define return runs for each of said mats to and from the location of said portions of said mats, wherein said means for sealing comprises inwardly-extending seals (23) for sealing said open sides of the mats so as to form an air-tight chamber inside each of the mats so that compressed air may be injected and stored in said chamber.

6. An apparatus as set forth in claim 2, further including means (9) for supporting said first and second mats so as to define return runs for each of said mats to and from the location of said portions of said mats, wherein said means for sealing comprises inwardly-extending seals (23) for sealing said open sides of the mats so as to form an air-tight chamber inside each of the mats so that compressed air may be injected and stored in said chamber.

7. An apparatus as set forth in claim 3, further including means (9) for supporting said first and second mats so as to define return runs for each of said mats to and from the location of said portions of said mats, wherein said means for sealing comprises inwardly-extending seals (23) for sealing said open sides of the mats so as to form an air-tight chamber inside each of the mats so that compressed air may be injected and stored in said chamber.

8. An apparatus according to claim 4, further including means (9) for supporting said first and second mats so as to define return runs for each of said mats to and from the location of said portions of said mats, wherein said means for sealing comprises inwardly-extending seals (23) for sealing said open sides of the mats so as to form an air-tight chamber inside each of the mats so that compressed air may be injected and stored in said chamber.

9. An apparatus according to claim 4, wherein said mat stretching means further comprises means, coupled to said frame plates (21), for causing said frame plates (21) to pivot so as to adjust the amount said mats are stretched.

10. An apparatus according to claim 3, further comprising frame plates (21); drive shafts (18) journaled to said frame plates; sprocket means (14) for engaging said chains (13) and for translating the direction of travel of said chain tracks (12, 13) between two positions, said sprocket means (14) being mounted to said drive shafts (18); swing rollers (3, 4), positioned at opposite ends of said portions of said mats so that the longitudinal axis of said drive shafts (18) are inclined with respect to the axis of rotation of at least some of said rollers (4); a drive motor (2), coupled to said to said shafts (18); wherein said frame plates (21) are pivotally mounted to said apparatus and said mats (1, 2) are passed around said swing rollers (3, 4).

11. An apparatus according to claim 1, further comprising actuator means coupled to said mat stretching means for actuating said mat stretching means so as to stretch said mats so that the stretching force applied by said mats to said hide increases continuously as said hide advances in said direction.

12. An apparatus according to claim 1, further comprising return run means for allowing portions of said first and second mats traveling in a third direction opposite said direction to return to an unstretched condition.

* * * * *